US011674512B2

(12) United States Patent
Wu

(10) Patent No.: US 11,674,512 B2
(45) Date of Patent: Jun. 13, 2023

(54) TWO-STAGE SCREW COMPRESSOR AND AIR CONDITIONING SYSTEM

(71) Applicant: Carrier Corporation, Palm Beach Gardens, FL (US)

(72) Inventor: Hu Wu, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/702,322

(22) Filed: Mar. 23, 2022

(65) Prior Publication Data

US 2022/0307502 A1 Sep. 29, 2022

(30) Foreign Application Priority Data

Mar. 25, 2021 (CN) ..... 202110319342.X

(51) Int. Cl.

| | |
|---|---|
| ***F04C 11/00*** | (2006.01) |
| ***F04C 18/16*** | (2006.01) |
| ***F04C 29/00*** | (2006.01) |

(52) U.S. Cl.

CPC ..... *F04C 18/16* (2013.01); *F04C 29/005* (2013.01); *F04C 2240/30* (2013.01)

(58) Field of Classification Search

CPC ..... F04C 18/16; F04C 29/005; F04C 11/001; F04C 11/008; F04C 23/001

See application file for complete search history.

(56) References Cited

U.S. PATENT DOCUMENTS

| | | | | |
|---|---|---|---|---|
| 3,395,643 | A * | 8/1968 | Whitomore | F04C 11/00 415/110 |
| 5,795,136 | A | 8/1998 | Olsaker et al. | |
| 2004/0101411 | A1* | 5/2004 | Nichol | F04C 28/08 417/42 |
| 2009/0123302 | A1* | 5/2009 | Nishimura | F04C 29/005 418/199 |
| 2012/0251372 | A1 | 10/2012 | Nishimura et al. | |

FOREIGN PATENT DOCUMENTS

| | | | | |
|---|---|---|---|---|
| JP | S614889 | A | 1/1986 | |
| JP | 2007040294 | A | 2/2007 | |
| TW | 201736787 | A * | 10/2017 | F04C 23/003 |

OTHER PUBLICATIONS

English translation of TW-201736787 by PE2E Aug. 29, 2022.*
European Search Report for Application No. 22159827.9; dated Sep. 9, 2022; 6 Pages.

* cited by examiner

*Primary Examiner* — Deming Wan
(74) *Attorney, Agent, or Firm* — Cantor Colburn LLP

(57) ABSTRACT

A two-stage screw compressor and an air conditioning system. The two-stage screw compressor includes: a housing with an intake port and an exhaust port provided thereon; a low-pressure stage screw set axially arranged in the housing and connected to the intake port; a high-pressure stage screw set axially arranged in the housing and connected to the exhaust port; a drive motor axially arranged in the housing; and a transmission gear set for simultaneously transmitting a torque provided by the drive motor to the low-pressure stage screw set and the high-pressure stage screw set; wherein, the drive motor, the low-pressure stage screw set and the high-pressure stage screw set are axially arranged on the same side of the transmission gear set.

9 Claims, 10 Drawing Sheets

TWO-STAGE SCREW COMPRESSOR AND AIR CONDITIONING SYSTEM

FOREIGN PRIORITY

This application claims priority to Chinese Patent Application No. 202110319342.X, filed Mar. 25, 2021, and all the benefits accruing therefrom under 35 U.S.C. § 119, the contents of which in its entirety are herein incorporated by reference.

TECHNICAL FIELD OF INVENTION

The present invention relates to the field of air conditioning, in particular to a two-stage screw compressor and an air conditioning system having the same.

BACKGROUND OF THE INVENTION

At present, refrigeration systems and related equipment have been widely used in various temperature control fields including household air conditioning, commercial air conditioning, cold chain transportation, and cryogenic storage. Among them, for application scenarios with low evaporating temperature and large refrigerating capacity demand, such as refrigeration and low-temperature environmental laboratories, large refrigeration equipment is usually required. As the power supply device in large refrigeration equipment, two-stage or three-stage screw compressors are generally used to bear relatively high loads.

Two-stage rotors of conventional two-stage screw compressors can be connected in series by couplings. At this time, in order to ensure that the installations of the couplings do not interfere with each other, and considering the large length occupied by the tandem arrangement of the screw set, the unit itself needs to be designed to have a larger volume. In addition, there is also the problem of inaccurate centring of the couplings, which increases noise and affects the operation of the compressor, thereby reducing the efficiency of the compressor.

SUMMARY OF THE INVENTION

The present invention aims to provide a two-stage screw compressor and an air conditioning system, to at least partially solve or alleviate the problems existing in the prior art.

In order to achieve at least one objective of the present application, according to one aspect of the present application, a two-stage screw compressor is provided, which comprises: a housing with an intake port and an exhaust port provided thereon; a low-pressure stage screw set axially arranged in the housing and connected to the intake port; a high-pressure stage screw set axially arranged in the housing and connected to the exhaust port; a drive motor axially arranged in the housing; and a transmission gear set for simultaneously transmitting a torque provided by the drive motor to the low-pressure stage screw set and the high-pressure stage screw set; wherein, the drive motor, the low-pressure stage screw set and the high-pressure stage screw set are axially arranged on the same side of the transmission gear set.

In addition to one or more of the above features, or as an alternative, in another embodiment, the low-pressure stage screw set and the high-pressure stage screw set are arranged on the same side of a vertical plane where the axis of the drive motor is located.

In addition to one or more of the above features, or as an alternative, in another embodiment, the low-pressure stage screw set is arranged at a lower part of the high-pressure stage screw set.

In addition to one or more of the above features, or as an alternative, in another embodiment, the transmission gear set comprises: a driving gear connected to the drive motor; a low-pressure stage driven gear connected to a low-pressure stage driving screw of the low-pressure stage screw set; and a high-pressure stage driven gear connected to a high-pressure stage driving screw of the high-pressure stage screw set; wherein, the gear ratio of the driving gear to the low-pressure stage driven gear is greater than the gear ratio of the driving gear to the high-pressure stage driven gear.

In addition to one or more of the above features, or as an alternative, in another embodiment, the gear ratio of the driving gear to the low-pressure stage driven gear is 1:1 to 10:1; and/or the gear ratio of the driving gear to the high-pressure stage driven gear is 0.5:1 to 9:1.

In addition to one or more of the above features, or as an alternative, in another embodiment, a compression flow path passing in sequence through the intake port, a first cavity for accommodating the low-pressure stage screw set, a second cavity for accommodating the drive motor, a third cavity for accommodating the high-pressure stage screw set, and the exhaust port is formed in the housing.

In addition to one or more of the above features, or as an alternative, in another embodiment, the housing is further provided with an intermediate-stage air supplement port, which is connected to the second cavity.

In addition to one or more of the above features, or as an alternative, in another embodiment, the intake port is radially connected to the low-pressure stage driving screw of the low-pressure stage screw set.

In addition to one or more of the above features, or as an alternative, in another embodiment, the exhaust port is axially connected to the high-pressure stage driven screw of the high-pressure stage screw set.

In order to achieve at least one objective of the present application, according to another aspect of the present application, an air conditioning system is further provided, which comprises the aforementioned two-stage screw compressor.

According to the two-stage screw compressor of the present application, on the one hand, through the transmission gear set, the torque of the drive motor is simultaneously transmitted to the low-pressure stage screw set and the high-pressure stage screw set, and by upgrading the conventional arrangement of screws in series into the arrangement of screws in parallel, the axial dimension of the compressor is effectively reduced; on the other hand, compared with the conventional transmission mode of directly connecting the motor to the screws, the transmission mode of gear drive can realize the change of transmission direction, thus allowing the drive motor, the low-pressure stage screw set and the high-pressure stage screw set to be axially arranged on the same side of the transmission gear set, which further reduces the axial dimension of the compressor. This arrangement makes the overall space occupied change from a similar cuboid to a similar cube, thus effectively improving the space utilization rate and reducing the size of the unit. An air conditioning system with a two-stage screw compressor arranged in this way also has corresponding technical effects.

DETAILED DESCRIPTION OF THE INVENTION

The present application will be described in detail hereinafter with reference to the exemplary embodiments shown in the accompanying drawings. It should be understood, however, that the present application can be implemented in many different forms, and should not be construed as being limited to the embodiments set forth herein. These embodiments are provided here for the purpose of making the disclosure of the present application more thorough and complete, and fully conveying the concept of the present application to those skilled in the art.

In addition, for any single technical feature described or implied in the embodiments mentioned herein, or any single technical feature displayed or implied in each drawing, the present application still allows any continued arbitrary combination or deletion of these technical features (or the equivalents thereof) without any technical obstacles, thereby obtaining more other embodiments of the present application that may not be directly mentioned herein.

For the convenience of describing the embodiments mentioned herein, axial direction, radial direction and vertical direction are introduced here as the reference coordinates. This way of describing directions aims to express the structural characteristics of the respective components themselves and the relative positional relationships between the components, rather than to restrict the absolute positional relationships thereof. Taking the screw in the two-stage screw compressor in FIG. 3 as an example, the axial direction refers to the indicated direction of the rotation axis of the screw, or the extension direction of the length of the screw, and the radial direction refers to the indicated direction of the screw perpendicular to the axis, or the extension direction of the radius of the screw. In addition, the direction from bottom to top of the two-stage screw compressor shown in the figure is the vertical direction. In order to show the positional relationships thereof more clearly, some of the drawings show the axial direction with the X-axis, the radial direction with the Y-axis, and the vertical direction with the Z-axis.

Figure 1:
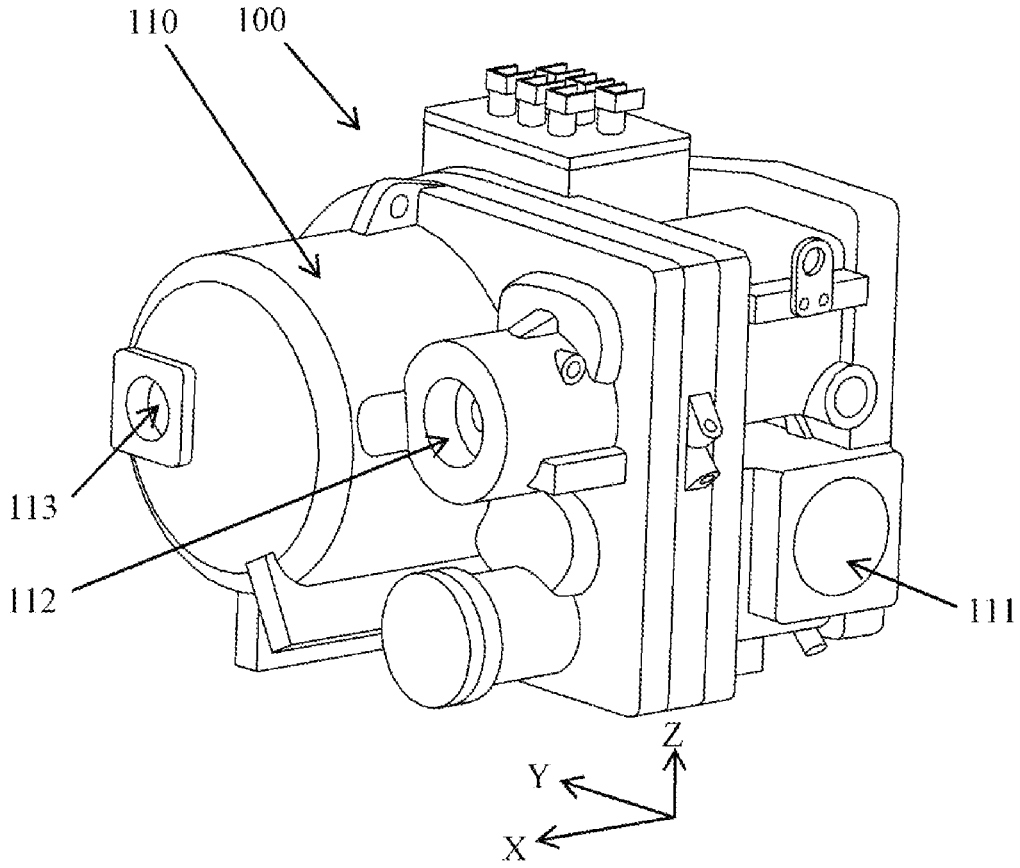
FIG. 1 is a schematic diagram of an embodiment of the two-stage screw compressor of the present application.
Figure 2:
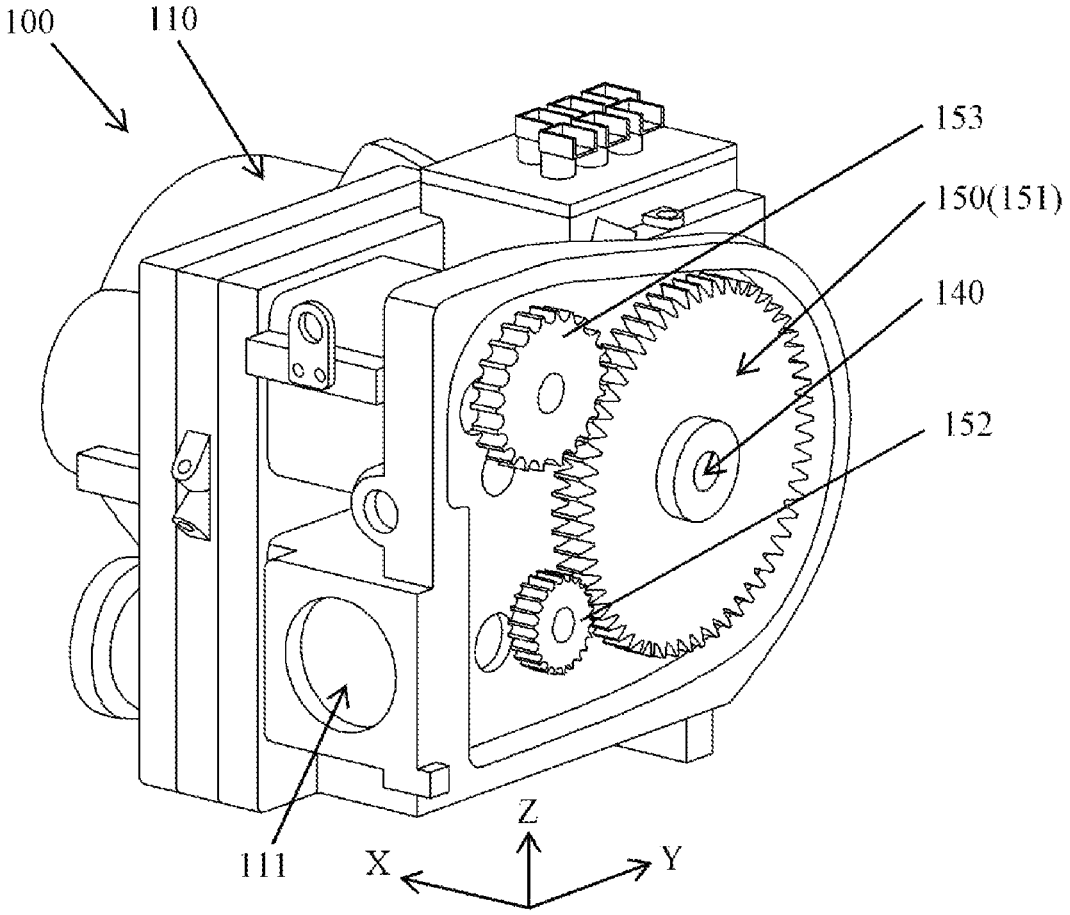
FIG. 2 is a schematic diagram of an embodiment of the two-stage screw compressor of the present application, in which part of the housing outside the transmission gear set is omitted.
Figure 3:
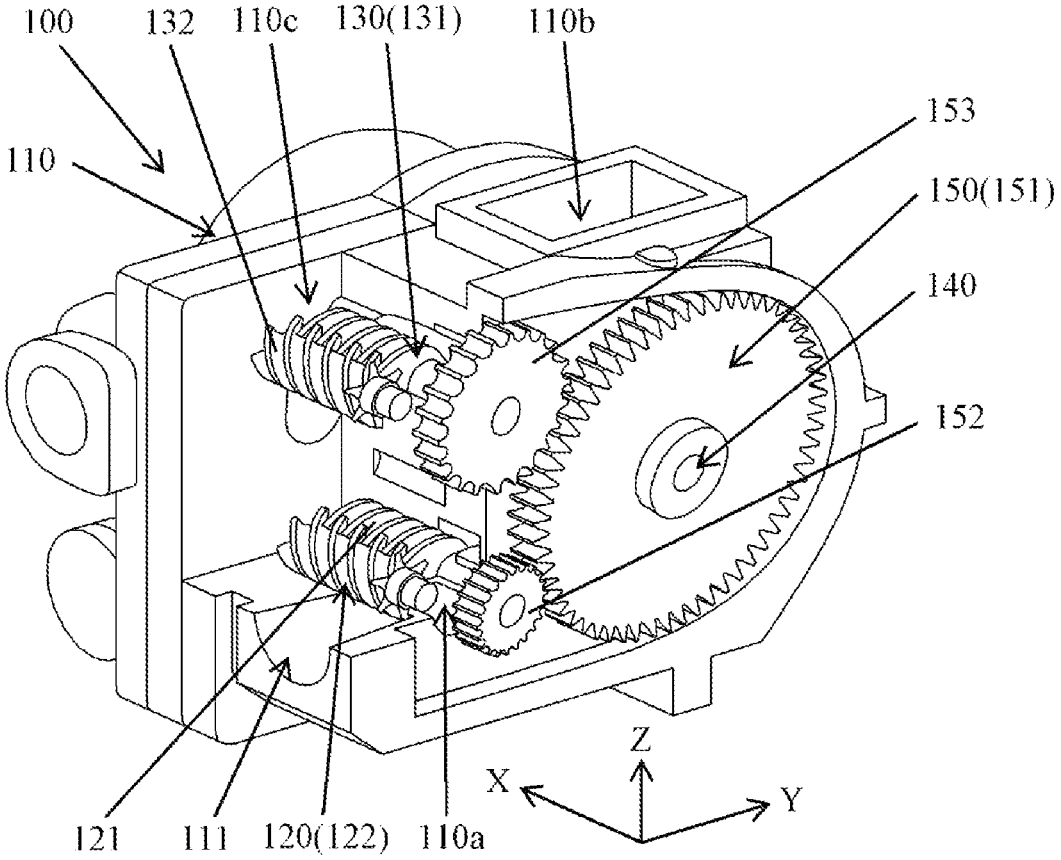
FIG. 3 is a schematic diagram of an embodiment of the two-stage screw compressor of the present application, in which part of the housing outside the transmission gear set, the low-pressure stage screw set and the high-pressure stage screw set is omitted.
Figure 4:
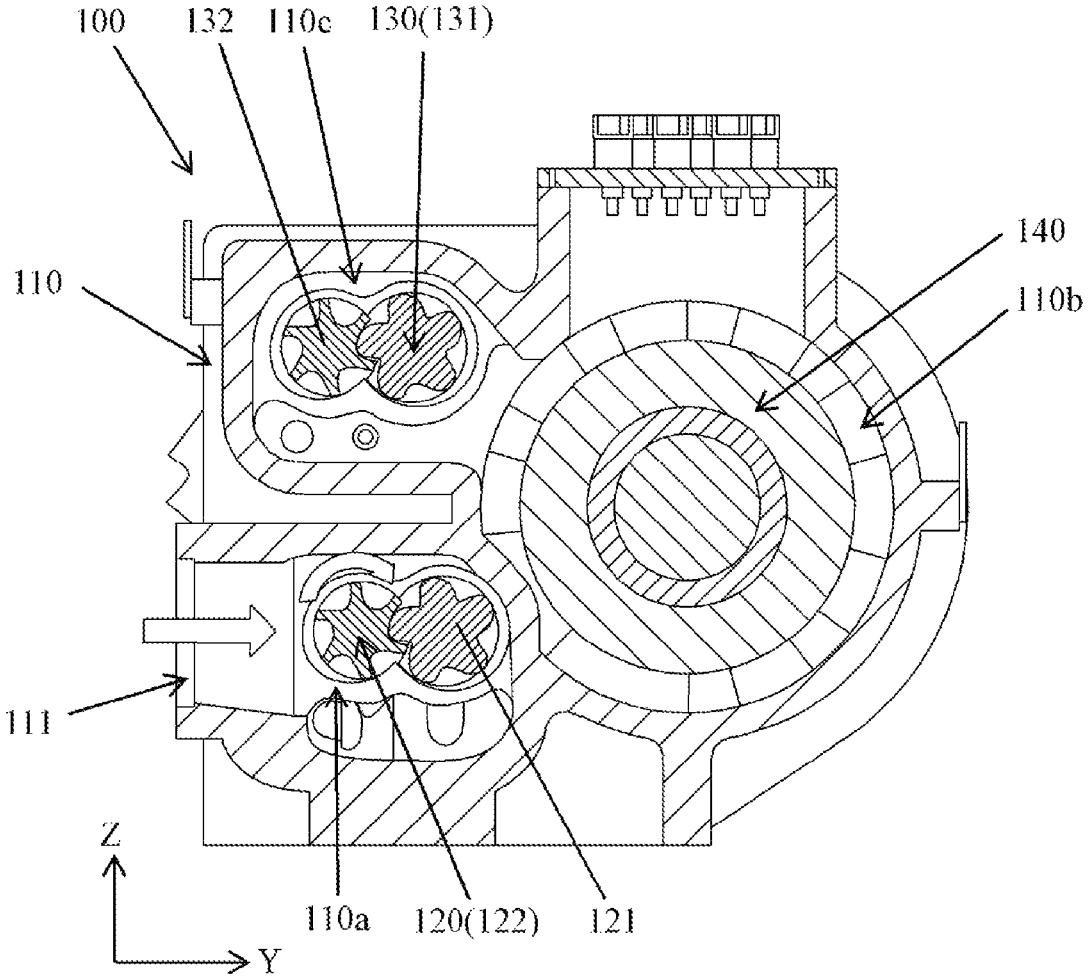
FIGS. 4 to 10 show various stages of the flow path of the refrigerant in the two-stage screw compressor of the present application from different cross-sections and perspectives.
Figure 5:
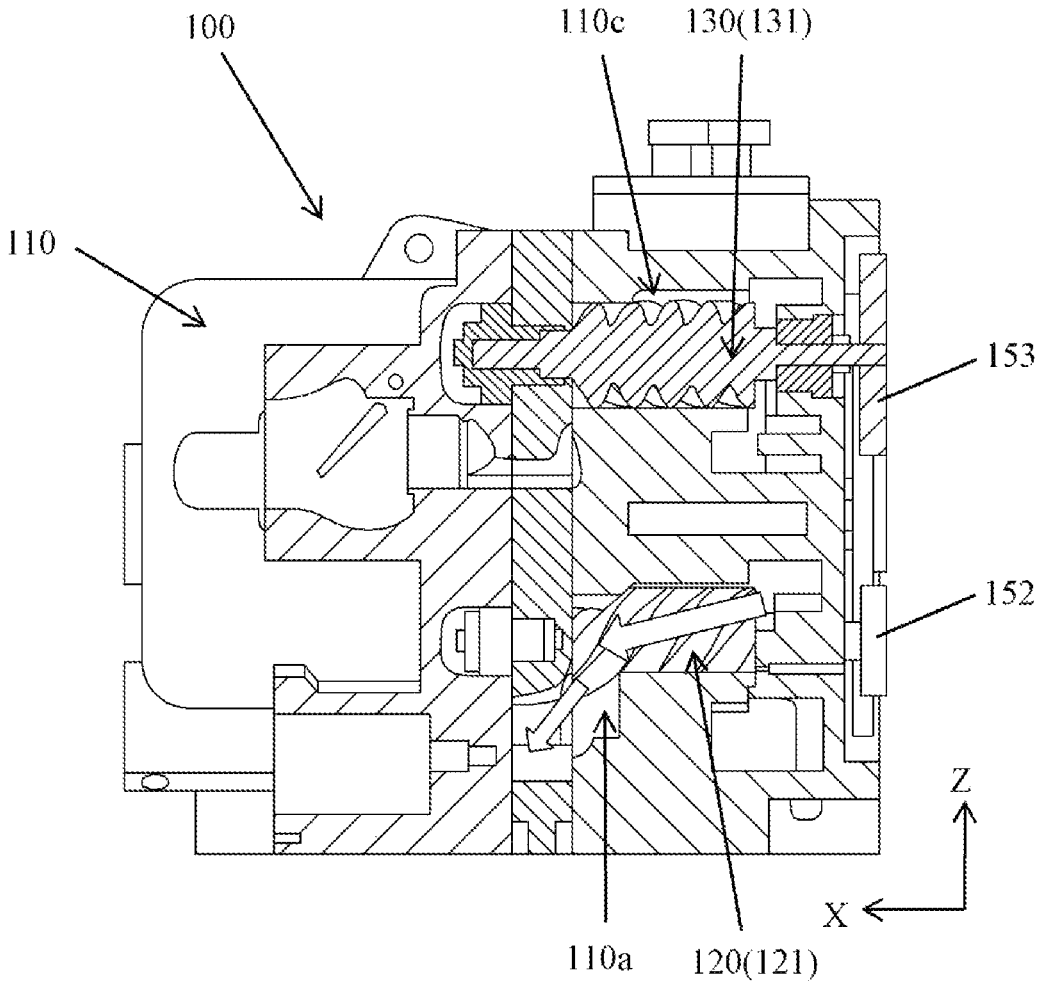
Figure 6:
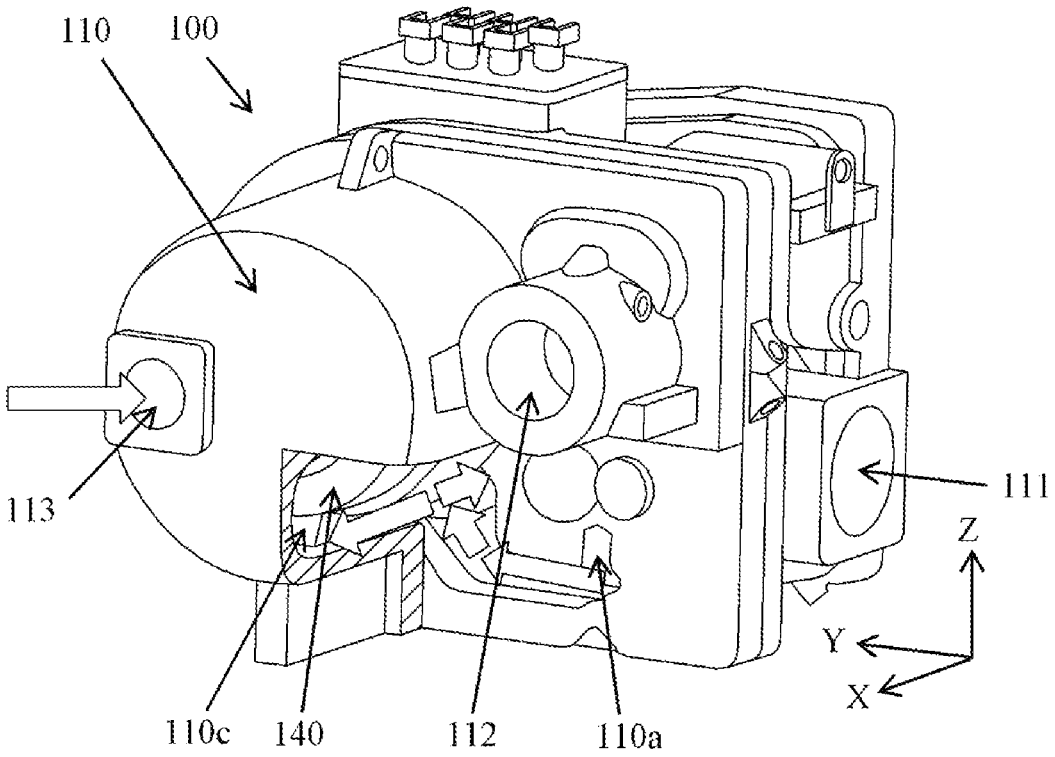
Figure 7:
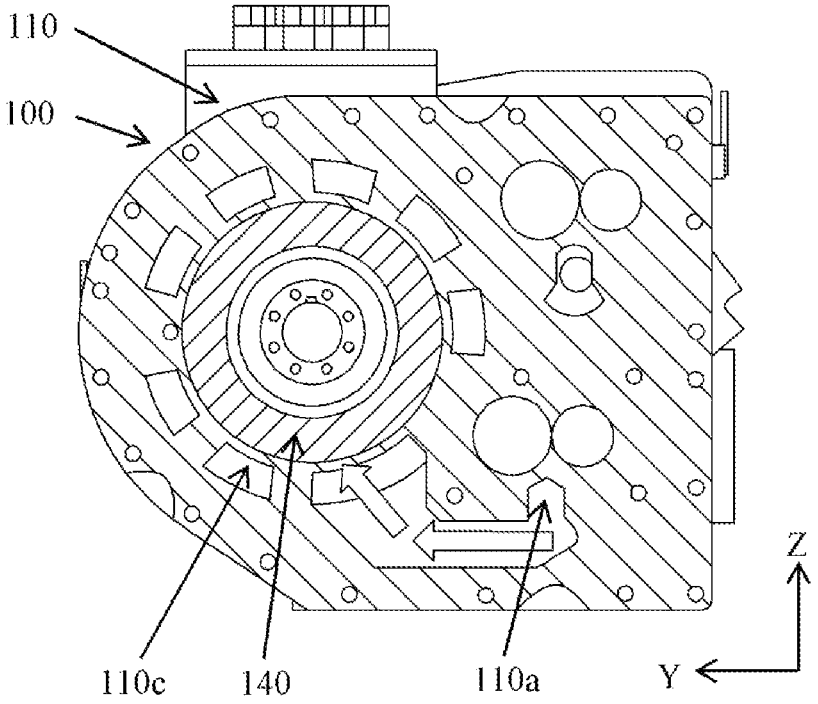
Figure 8:
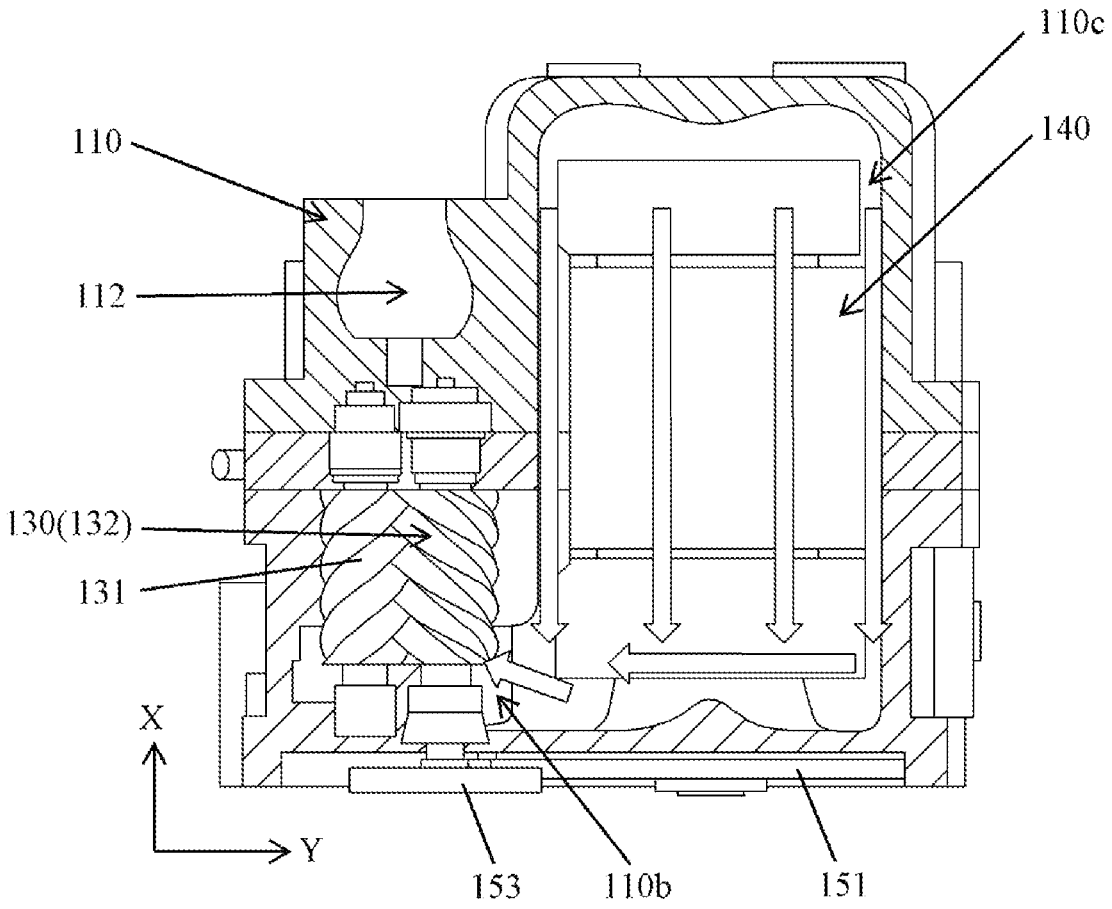
Figure 9:
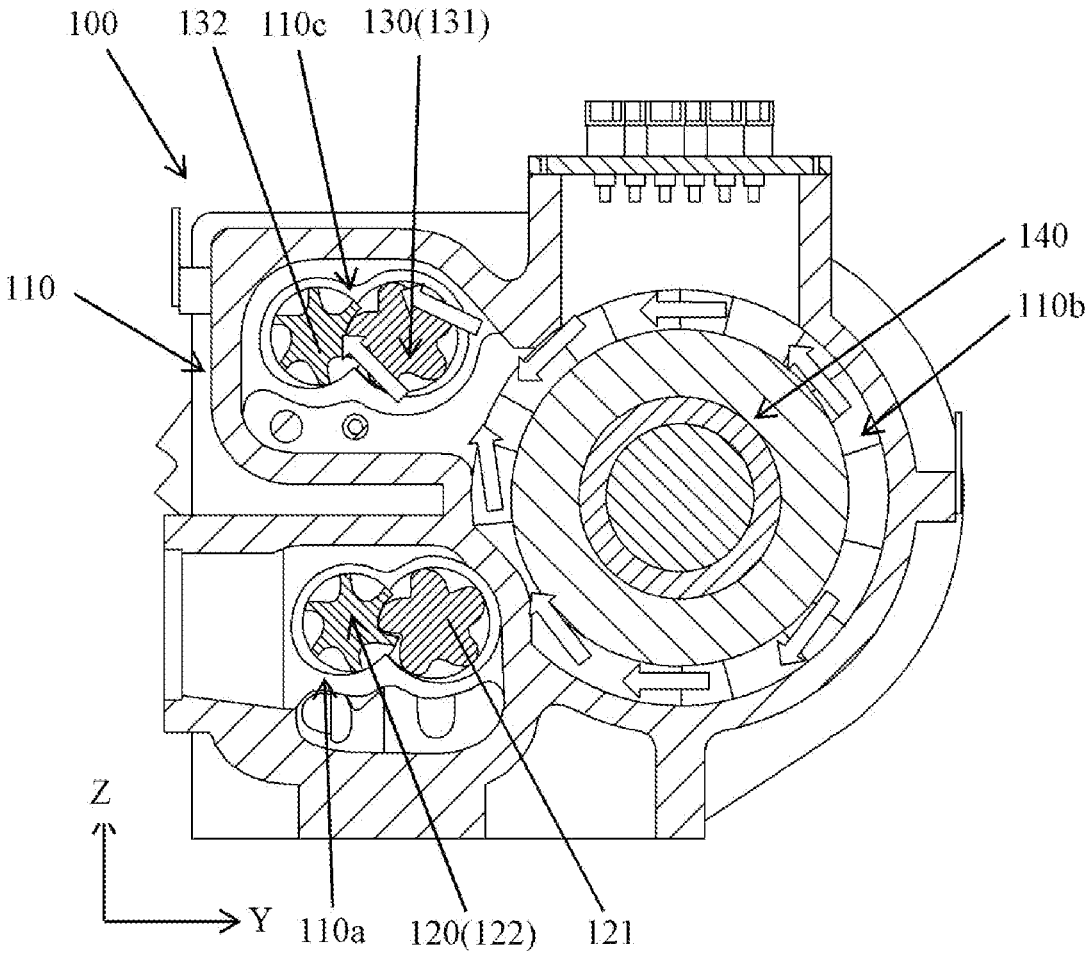
Figure 10:
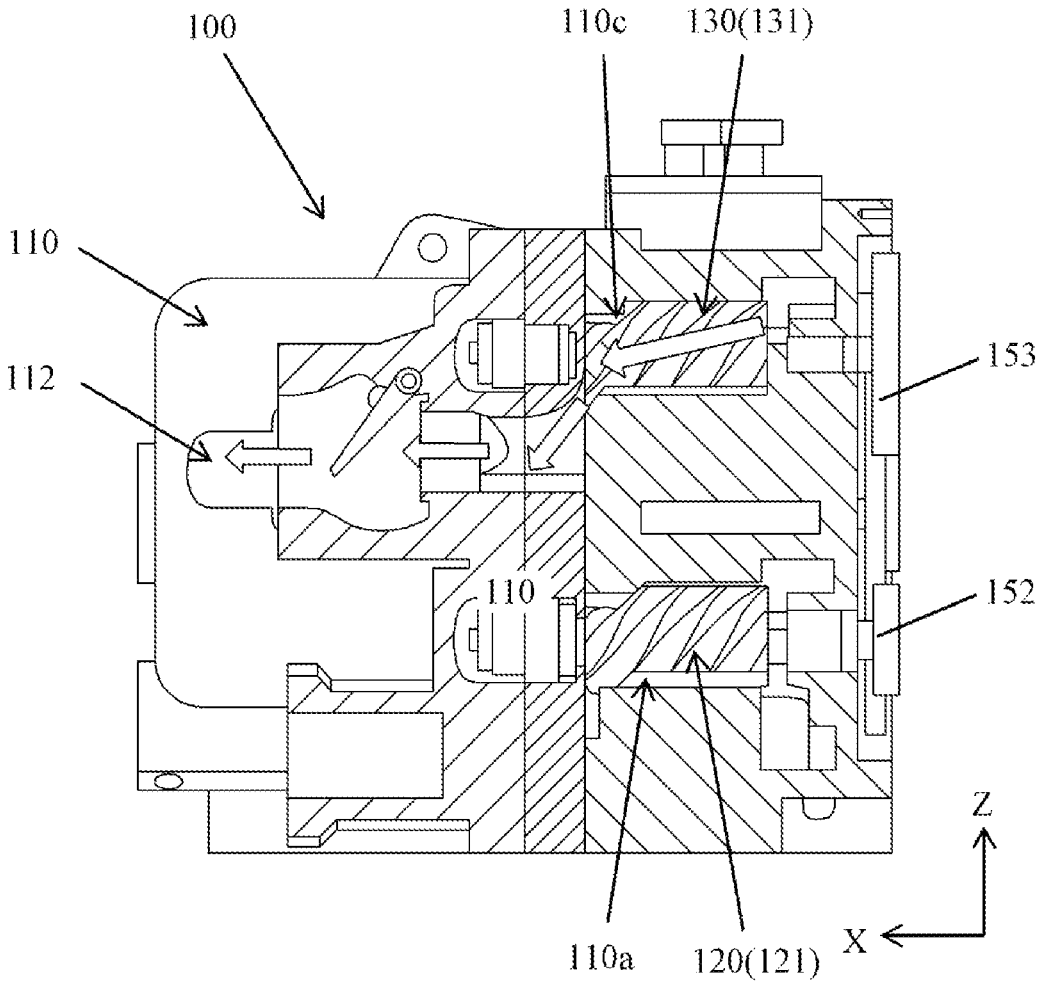

Referring to FIGS. 1 to 3, an embodiment of a two-stage screw compressor according to the present application is shown. The two-stage screw compressor 100 comprises a housing 110 and a low-pressure stage screw set 120, a high-pressure stage screw set 130, a drive motor 140 and a transmission gear set 150 arranged in the housing 110. The housing is further provided with an intake port 111 and an exhaust port 112, wherein the intake port 111 is connected to the low-pressure stage screw set 120, and the exhaust port 112 is connected to the high-pressure stage screw set 130, so that the fluid flows into the compressor 100, and flows out of the compressor 100 after undergoing compression.

The low-pressure stage screw set 120 comprises a low-pressure stage driving screw 121 and a low-pressure stage driven screw 122 that mesh with each other, and there is a compression cavity for fluid to flow through between the meshing parts of the two. The intake port 111 is connected to the low-pressure stage driven screw 122 of the low-pressure stage screw set 120 in the radial direction Y, so as to achieve a first-stage compression of the fluid flowing therefrom.

The high-pressure stage screw set 130 comprises a high-pressure stage driving screw 131 and a high-pressure stage driven screw 132 that mesh with each other, and there is a compression cavity for fluid to flow through between the meshing parts of the two, so as to achieve a second-stage compression of the fluid flowing therefrom which has undergone the first-stage compression. The exhaust port 112 is connected to the high-pressure stage driven screw 132 of the high-pressure stage screw set 130 in the axial direction X, so as to guide the fluid which has undergone the second-stage compression to flow out of the two-stage screw compressor 100.

In order to achieve the transmission of power between the drive motor 140 and the screw sets, the transmission gear set 150 may be connected to the drive motor 140, the low-pressure stage screw set 120 and the high-pressure stage screw set 130 respectively, so that the torque provided by the drive motor 140 can be transmitted to the low-pressure stage screw set 120 and the high-pressure stage screw set 130 simultaneously.

In addition, in order to optimize the space in the compressor and realize a compact and reasonable arrangement of the respective components, all of the low-pressure stage screw set 120, the high-pressure stage screw set 130 and the drive motor 140 may be axially (X) arranged inside the housing 110, and the drive motor 140, the low-pressure stage screw set 120 and the high-pressure stage screw set 130 are arranged on the same side of the transmission gear set 150 in the axial direction X.

Under this arrangement, on the one hand, through the transmission gear set, the torque of the drive motor is simultaneously transmitted to the low-pressure stage screw set and the high-pressure stage screw set, and by upgrading the conventional arrangement of screws in series into the arrangement of screws in parallel, the axial dimension of the compressor is effectively reduced; on the other hand, compared with the conventional transmission mode of directly connecting the motor to the screws, the transmission mode of gear drive can realize the change of transmission direction, thus allowing the drive motor, the low-pressure stage screw set and the high-pressure stage screw set to be axially arranged on the same side of the transmission gear set, which further reduces the axial dimension of the compressor. This arrangement makes the overall space occupied change from a similar cuboid to a similar cube, thus effectively improving the space utilization rate and reducing the size of the unit.

Further modifications of the two-stage screw compressor will be introduced below by way of examples, in order to further improve its working efficiency, reliability or out of improvement considerations in other aspects.

For example, in order to further optimize the compactness of the arrangement in the compressor housing, the low-pressure stage screw set 120 and the high-pressure stage screw set 130 may be arranged on the same side of the drive motor 140. Considering that the radial dimension of the drive motor is normally greater than the radial dimensions of the low-pressure stage screw set 120 and the high-pressure stage screw set 130, this arrangement can allocate the arrangement space in the radial direction Y in the housing in a more reasonable manner. More specifically, one of the low-pressure stage screw set 120 and the high-pressure stage screw set 130 may be arranged at a lower part of the other, and at this time, the three are arranged in a roughly triangular manner in the radial direction Y. While making the most of the radial space, the axial length is reduced to a greater extent. Wherein, since the low-pressure cavity corresponding to the low-pressure stage screw set 120 usually needs to be provided with an unloading valve for pressure relief, when the low-pressure stage screw set 120 is arranged at the lower part, the unloading valve can be directly arranged at the bottom of the housing; but when the low-pressure stage screw set 120 is arranged at the upper part, additional space is required to dispose the unloading valve, which will lead to a slightly reduced compactness. Therefore, it is more recommended to arrange the low-pressure stage screw set 120 at the lower part of the high-pressure stage screw set 130.

As another example, as a specific implementation form of the transmission gear set 150, it may comprise a driving gear 151 fixedly connected to the output axis of the drive motor 140, a low-pressure stage driven gear 152 fixedly connected to the end of a low-pressure stage driving screw 121 of the low-pressure stage screw set 120, and a high-pressure stage driven gear 153 fixedly connected to the end of a high-pressure stage driving screw 131 of the high-pressure stage screw set 130; wherein the gear ratio of the driving gear 151 to the low-pressure stage driven gear 152 is greater than the gear ratio of the driving gear 151 to the high-pressure stage driven gear 153. At this time, driven by the drive motor 140, the driving gear 151 rotates with the output axis of the drive motor 140, and simultaneously transmits the torque to the low-pressure stage driven gear 152 and the high-pressure stage driven gear 153 through the meshing relationship. Since the low-pressure stage driven gear 152 has fewer teeth and the high-pressure stage driven gear 153 has more teeth, when driven by the same driving gear, the low-pressure stage driven gear 152 rotates at a faster speed, so that the corresponding low-pressure stage driving screw 121 and the matched low-pressure stage driven screw 122 rotate rapidly, and compress the fluid with low pressure; whereas, the high-pressure stage driven gear 153 rotates at a slower speed and has a larger torque, so that the corresponding high-pressure stage driving screw 131 and the matched high-pressure stage driven screw 132 rotate slowly, and compress the fluid with high pressure. More specifically, the gear ratio of the driving gear 151 to the low-pressure stage driven gear 152 is 1:1 to 10:1; and/or the gear ratio of the driving gear 151 to the high-pressure stage driven gear 153 is 0.5:1 to 9:1. In this way, synchronously drive of the two-stage compression screw set can be realized, and the compression difference between the two and the overall compression efficiency of the compressor can be effectively achieved.

In still another example, a specific compression flow path may be formed in the housing 110 to direct the flow and compression of the fluid. Specifically, the compression flow path may be formed by passing in sequence through the intake port 111, a first cavity 110*a* for accommodating the low-pressure stage screw set 120, a second cavity 110*b* for accommodating the drive motor 140, a third cavity 110*c* for accommodating the high-pressure stage screw set 130, and the exhaust port 112.

On this basis, in order to achieve the air-supplement enthalpy-adding effect of the two-stage compressor, the housing 110 of the compressor may further be provided with an intermediate-stage air supplement port 113, which is connected to the second cavity 110*b* in the axial direction X, so as to guide the gas phase fluid formed by flash by the economizer into the compressor therefrom.

The compression process of the fluid to be compressed (taking refrigerant as an example) in the two-stage screw compressor of the present application will be described below in conjunction with FIGS. 4 to 10, in which the flow direction of the refrigerant is shown with arrows. First, with reference to FIGS. 4 to 5, the low-pressure refrigerant is drawn into the first cavity 110*a* of the two-stage screw compressor in the radial direction Y via the intake port 111, and in the process of flowing in the axial direction X, is compressed by the low-pressure stage screw set 120 arranged in the first cavity 110*a*. With continued reference to FIGS. 6 to 7, the refrigerant which has undergone the first-stage compression flows into the second cavity 110*b* where the drive motor 140 is arranged in the radial direction Y; at the same time, if the air supplement function is turned on, the outside gas-phase refrigerant also flows into the second cavity 110*b* via the intermediate-stage air supplement port 113, and is fully mixed with the refrigerant which has undergone the first-stage compression. Next, with reference to FIGS. 8 to 9, the mixed refrigerant is guided from the second cavity 110*b* to the third cavity 110*c* where the high-pressure stage screw set 130 is arranged. Last, with reference to FIG. 10, the refrigerant entering the third cavity 110*c* is compressed by the high-pressure stage screw set 130 arranged in the third cavity 110*c* in the process of flowing in the axial direction X, and the refrigerant which has undergone two stages of compression flows out of the two-stage screw compressor 100 via the exhaust port 112.

In addition, although not shown in the figures, an embodiment of an air conditioning system according to the present application is further provided herein. The air conditioning system comprises the two-stage screw compressor mentioned in any of the foregoing embodiments or a combination thereof, and thus also has corresponding technical effects, which will not be repeated here.

Wherein, those skilled in the art should understand that the air conditioning system set forth in the present application does not refer to the air conditioner with outdoor refrigeration/heating unit and indoor heat exchange unit used in buildings in the industry in a narrow sense. It, however, should be understood as a thermal system with the function of air conditioning, which, when driven by various power sources (such as electricity), exchanges heat with the air at the location to be conditioned through the phase change of the refrigerant in the system. For example, when the air conditioning system is used for building HVAC, it may be a refrigeration system with cooling function only, or it may be a heat pump system with both cooling and heating capabilities. For another example, when the air conditioning system is used in the field of cold chain, it may be a transport refrigeration system or a refrigeration/freezing system. However, no matter what form of air conditioning system it is, there should be a two-stage screw compressor so as to be applicable to the concept of the present application.

The above examples mainly illustrate the two-stage screw compressor and the air conditioning system of the present invention. Although only some of the embodiments of the present invention are described, those skilled in the art understand that the present invention may, without departing from the spirit and scope thereof, be implemented in many other forms. Therefore, the illustrated examples and embodiments are to be considered as illustrative but not restrictive, and the present application may cover various modifications or replacements if not departed from the spirit and scope of the present application as defined by the appended claims.

What is claimed is:

1. A two-stage screw compressor, comprising:

a housing with an intake port and an exhaust port provided thereon;

a low-pressure stage screw set axially arranged in the housing and connected to the intake port;

a high-pressure stage screw set axially arranged in the housing and connected to the exhaust port;

a drive motor; and a transmission gear set for simultaneously transmitting a torque provided by the drive motor to the low-pressure stage screw set and the high-pressure stage screw set;

wherein, the drive motor, the low-pressure stage screw set and the high-pressure stage screw set are axially arranged on the same side of the transmission gear set;

wherein, a compression flow path passing in sequence through the intake port, a first cavity for accommodating the low-pressure stage screw set, a second cavity for accommodating the drive motor, a third cavity for accommodating the high-pressure stage screw set, and the exhaust port is formed in the housing.

2. The two-stage screw compressor according to claim 1, wherein the low-pressure stage screw set and the high-pressure stage screw set are arranged on the same side of a vertical plane where the axis of the drive motor is located.

3. The two-stage screw compressor according to claim 2, wherein the low-pressure stage screw set is arranged at a lower part of the high-pressure stage screw set.

4. The two-stage screw compressor according to claim 1, wherein the transmission gear set comprises:

a driving gear connected to the drive motor;

a low-pressure stage driven gear connected to a low-pressure stage driving screw of the low-pressure stage screw set; and a high-pressure stage driven gear connected to a high-pressure stage driving screw of the high-pressure stage screw set;

wherein, the gear ratio of the driving gear to the low-pressure stage driven gear is greater than the gear ratio of the driving gear to the high-pressure stage driven gear.

5. The two-stage screw compressor according to claim 4, wherein, the gear ratio of the driving gear to the low-pressure stage driven gear is 1:1 to 10:1; and/or the gear ratio of the driving gear to the high-pressure stage driven gear is 0.5:1 to 9:1.

6. The two-stage screw compressor according to claim 1, wherein an intermediate-stage air supplement port connected to the second cavity is further provided on the housing.

7. The two-stage screw compressor according to claim 1, wherein the intake port is radially connected to the low-pressure stage driving screw of the low-pressure stage screw set.

8. The two-stage screw compressor according to claim 1, wherein the exhaust port is axially connected to the high-pressure stage driven screw of the high-pressure stage screw set.

9. An air conditioning system, comprising: the two-stage screw compressor according to claim 1.

* * * * *